United States Patent [19]

Brown et al.

[11] 4,305,350

[45] Dec. 15, 1981

[54] DUAL FUEL SYSTEM

[76] Inventors: Michael H. Brown, 101 Cherry Rd., Berea, Ky. 40403; James R. Cofield, 6224 Larcomb Dr.; Harold J. Jenks, 4720 Whitewood Ct., both of Dayton, Ohio 45424

[21] Appl. No.: 118,148

[22] Filed: Feb. 4, 1980

[51] Int. Cl.[3] ..... F02M 13/06

[52] U.S. Cl. ..... 123/59 PC; 123/575; 123/579

[58] Field of Search ..... 123/59 PC, 575–584; 261/23 R, 23 A

[56] References Cited

U.S. PATENT DOCUMENTS

| | | | |
|---|---|---|---|
| 1,257,089 | 2/1918 | Mason | 123/576 X |
| 1,541,851 | 6/1925 | Ristau, Jr. | 123/579 |
| 1,713,701 | 5/1929 | Kjellberg . | |
| 1,739,563 | 12/1929 | Thomas . | |
| 1,841,046 | 1/1932 | Mortenson et al. | 123/575 X |
| 2,023,634 | 12/1935 | Boudet | 123/143 B |
| 2,112,568 | 3/1938 | Hoops | 123/579 X |
| 3,186,691 | 6/1965 | Manning, Jr. | 261/23 |
| 3,563,220 | 2/1971 | Garner | 123/59 PC X |
| 3,718,000 | 2/1973 | Walker | 123/525 X |
| 4,013,050 | 3/1977 | Lace | 123/575 X |

*Primary Examiner*—Tony M. Argenbright
*Attorney, Agent, or Firm*—Biebel, French & Nauman

[57] ABSTRACT

A dual fuel system is disclosed which, when retrofitted to a standard gasoline engine of an automobile, permits the automobile to run on one of two fuels. The dual fuel system comprises two fuel tanks; two carburetors, each connected to a fuel tank and powered by a separate fuel pump; a venturi housing communicating with the carburetors and forming two venturi throats, each throat in registry with an outlet of a carburetor; an adapter forming a single passage therethrough and including an end adapted to be mounted on an intake manifold such that the passage is in registry with an intake opening in the intake manifold; a valve, located in between the venturi housing and the adapter means, for alternately opening and closing a pathway from a preselected venturi throat to the single passage of the adapter so that only one venturi throat communicates with the single passage at a time; a single throttle linkage connected to the throttles of the carburetors such that the throttles of the carburetors operate in unison; a valve linkage which allows remote control of the valve; and a slave linkage extending between the valve linkage and a distributor which is driven by the valve linkage and automatically adjusts the distributor to a predetermined setting by advancing or retarding the timing. The venturi housing may further include an exhaust gas heated helical duct for preheating the air-fuel mixture passing therethrough.

16 Claims, 13 Drawing Figures

DUAL FUEL SYSTEM

BACKGROUND OF THE INVENTION

1. Field of the Invention

The present invention relates to multiple carburetion systems for automobile internal combustion engines, and more particularly to those in which two carburetors, each fed from a separate fuel source, alternately feed a fuel-air mixture into a single opening of a manifold.

2. Prior Art

The constantly rising cost of gasoline has made it desirable to employ alternate fuels to power automobiles having internal combustion engines. Alcohol provides a less expensive and renewable substitute for gasoline; however, alcohol fuel is not yet as readily available as gasoline. Therefore, the need exists for an automobile having an internal combustion engine with separate alcohol and gasoline fuel systems so that a driver may elect to power the automobile with gasoline should he run out of alcohol fuel and none is immediately available.

There are many devices known in the art which provide a means for supplying different types of fuel to an internal combustion engine through separate carburetors whose operation may occur simultaneously or alternately. For example, U.S. Pat. No. 2,023,634 discloses an internal combustion engine fitted with two independently fueled carburetors which can alternately feed through a shut off valve into a common conduit which feeds through a throttle valve into a manifold. Such a device is not practical for retrofitting since specially designed carburetors which do not have integral throttle valves are required. In addition, a separate throttling device must be installed between the conduit and the manifold.

U.S. Pat. No. 2,435,192 discloses a dual carburetor fuel system in which two carburetors are operated separately so that one carburetor is in operation for low engine speeds and the second carburetor becomes operable in addition to the first carburetor during high engine speeds. The throttle for each carburetor is separately linked to a mechanism connected to an accelerator pedal. A disadvantage of this device is that it requires the use of two independently operating manifolds which feed into two separate engine ports.

U.S. Pat. No. 2,444,665 discloses a system whereby two carburetors are used alternately to power an internal combustion engine with two separate fuels. The means for alternating carburetors comprises a control which alternately switches the fuel flow in a section of fuel line common to both fuel systems. The control is activated by pressing one of two foot pedals in the passenger compartment of the automobile. However, there are inherent disadvantages to this system; namely, two pedals are required, each with a separate linkage to a carburetor, and the necessity of a section of fuel line common to both fuel tanks results in a problem of contaminating one fuel with another thereby fouling the carburetors.

Other examples of dual carburetor systems which utilize two accelerator pedals, each linked with only one carburetor are disclosed in U.S. Pat. Nos. 2,446,034 and 2,075,330.

Accordingly, it is an object of the present invention to provide a dual fuel system utilizing two carburetors, each throttled by one accelerator pedal by means of one linkage controlling both carburetor throttles.

An additional object of the invention is to provide a dual fuel system utilizing two carburetors in which both carburetors feed an air fuel mixture into a single opening in a single common manifold.

A further object of the invention is to provide a dual fuel system which can utilize carburetors of standard design.

SUMMARY OF THE INVENTION

The present invention provides a new dual fuel system utilizing two standard design carburetors that feed a fuel air mixture into a single opening in a single manifold, thereby reducing the overall complexity of the system and enabling the system to be retrofitted onto existing automobiles. The present invention also provides a dual fuel system utilizing two carburetors which are throttled by a single accelerator pedal which drives a single throttle linkage common to both carburetors. The use of a single accelerator pedal further reduces the overall complexity of the system and eliminates driver confusion as to which pedal to use for a desired fuel system.

The present invention is a dual fuel system which comprises two fuel tanks; two carburetors, each separately connected to a fuel reservoir; a venturi means communicating with each of the carburetors forming a separate venturi throat for each carburetor, each throat in registry with a separate outlet of a carburetor; an adapter means forming a single passage therethrough and having an end adapted to be mounted on an intake manifold such that the single passage communicates with an intake opening in the intake manifold; a valve means communicating with each separate venturi throat and with the single passage for alternating opening and closing a pathway from a predetermined venturi throat to the single passage so that only one venturi throat communicates with the single passage at a time; throttling linkage for controlling the throttle valves of the carburetors in unison, and a valve linkage which allows remote control of the valve means; and a slave linkage extending between the valve linkage and a distributor such that the distributor is adjusted to a predetermined setting by movement of the valve linkage. The present invention also provides a helical duct formed within one of the venturi throats which communicates with the exhaust system so that hot exhaust gases can flow through the duct thereby preheating the fuel air mixture flowing through that venturi throat.

There are several embodiments of the invention which can be used to accomplish effectively the desired objects of the invention. For example, the valve means may comprise two butterfly valves, each positioned within a venturi throat and controlled by a single linkage which terminates in the dashboard, such that as one butterfly valve is in the closed position, thereby cutting off the fuel air mixture from the respective venturi throat, the other butterfly valve is in the open position, thereby allowing the fuel air mixture to flow through the venturi throat into the intake manifold.

In a second embodiment of the invention the valve means comprises a slide plate forming a perforation and recessed within the lower portion of the venturi means. The slide plate is positioned by a remotely controlled "push-pull" linkage and is positioned such that in one position the perforation is in registry with a venturi throat so that a fuel air mixture can pass through one venturi throat and into the single passage while the slide plate obstructs the other venturi throat; in a second position, the perforation no longer is in registry with the venturi throat, the slide plate obstructs that venturi throat, and the end portion of the slide plate has moved to open a passageway which allows a fuel-air mixture from the other venturi throat to pass through to the single passage and into the intake manifold.

In a third embodiment, the valve means comprises a rotating disc which abuts the bottom surface of the venturi means and is recessed within a first spacer plate mounted above a second spacer plate which in turn is mounted on the adapter plate. The first and second spacer plates each form two holes whose centers are on a line with the center of the spacer plates and communicate with one another and an upper flared end of the single passage of the adapter means. The rotating disc forms two holes whose centers are not on a line with the center of the disc but are positioned thereon so that either one or the other can be placed in registry with the holes of the two spacer plates. The rotating disc is mounted to the venturi means by means of a shaft which passes therethrough and is connected by a linkage to a remote control which can pivot the rotating disc to bring one or the other holes in registry with the holes of the spacer plates thereby opening a passageway from a selected venturi throat to the manifold.

In a fourth embodiment, the valve means comprises an open-ended chamber forming a cylindrical interior and having openings which communicate with each of the venturi throats and with the adapter means. Rotatably mounted within the chamber is a drum having two skewed, nonintersecting channels therethrough such that as the drum is rotated a first passage connects a venturi throat with the single passage of the adapter means or a second passage connects the other venturi throat with the single passage of the adapter means. The cylinder is connected at an off-center portion to the "push-pull" valve linkage which can be remotely controlled to position the skewed channels of the drum.

In all of the above described embodiments of the invention a slave linkage is provided which is driven by the linkage controlling the valve means so that as one or the other carburetor is activated, the distributor of the automobile can be adjusted so that the timing is advanced or retarded according to the type of fuel being burned.

DETAILED DESCRIPTION OF THE PREFERRED EMBODIMENTS

Figure 1:
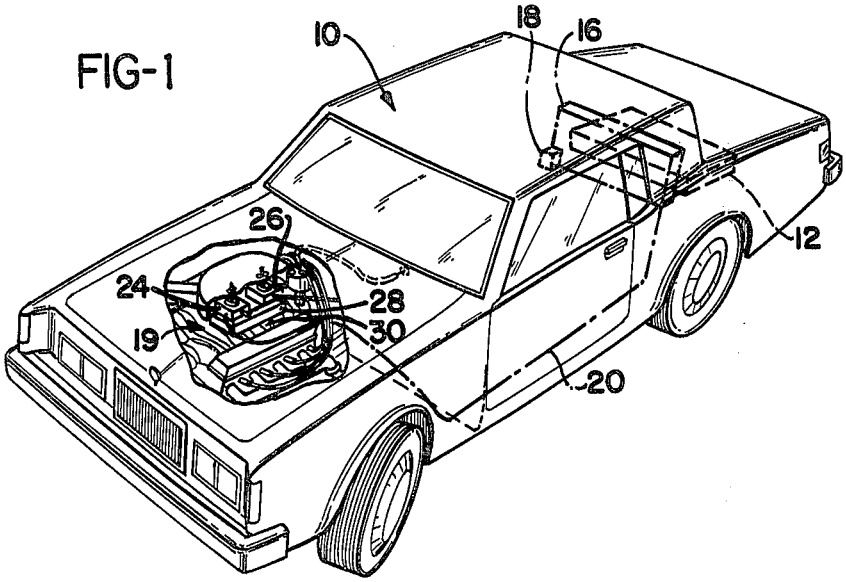
FIG. 1 is a perspective view of an automobile which is partially cut-away to show the positioning of the dual fuel system of the present invention.
Figure 2:
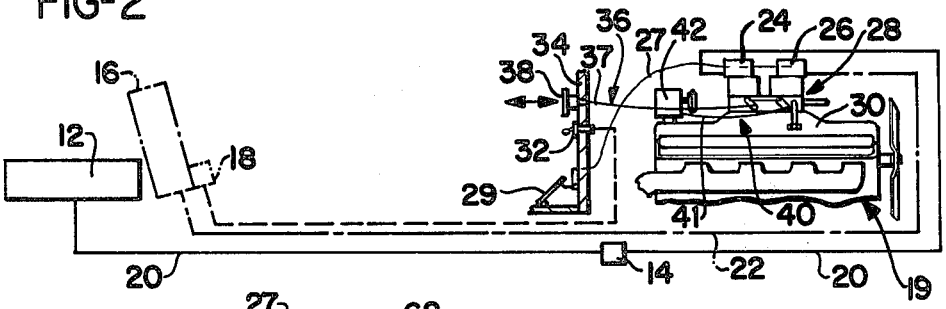
FIG. 2 is a schematic representation of the present invention.

As shown in FIGS. 1 and 2, the fuel system of the present invention can be retrofitted onto a standard automobile 10 having a standard fuel tank 12 and standard fuel pump 14. A second fuel tank 16 is added in the rear of the automobile 10 adjacent the standard fuel tank 12 and a second fuel pump 18 which supplies fuel from the second fuel tank to the engine 19 is positioned adjacent the second fuel tank in the rear of the automobile. The standard fuel tank 12 and second fuel tank 16 are connected by fuel lines 20, 22 to the first and second carburetors 24, 26 which are mounted on top of an adapter assembly 28 which in turn is mounted on top of the intake manifold 30. The first carburetor 24 is of a design that is standard for gasoline combustion. The second carburetor 26 is designed to mix properly an alternate fuel such as alcohol, in which case larger jets are needed than for mixing gasoline. The first and second carburetors 24, 26 are controlled by a throttle linkage 27 which extends between the carburetors and an accelerator pedal 29. Standard fuel pump 14 is the mechanical type and operates continuously. The second fuel pump 18 for second fuel tank 16 controlled by a fuel pump relay switch 32 mounted on the dashboard 34 of the automobile 10. The second fuel pump 18 is electric and is activated by the relay switch 32 when it is desired to operate the automobile on the fuel in the second fuel tank 16. Valve linkage 36, which operates the adapter assembly, includes a "push-pull" wire 37 which extends between a knob 38 mounted on the dashboard 34 of the automobile 10 and the adapter assembly 28. The valve linkage 36 activates a slave linkage 40, also including a "push-pull" wire 41, which is connected to the distributor 42 of the engine and can advance or retard the timing depending upon the type of fuel being used.

Figure 3:
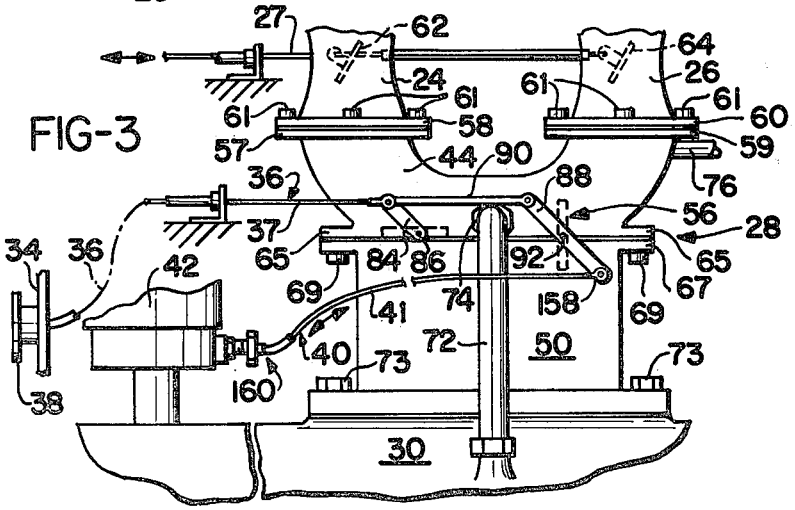
FIG. 3 is an elevation of a preferred embodiment of the present invention showing the linkage for the valve means.
Figure 4:
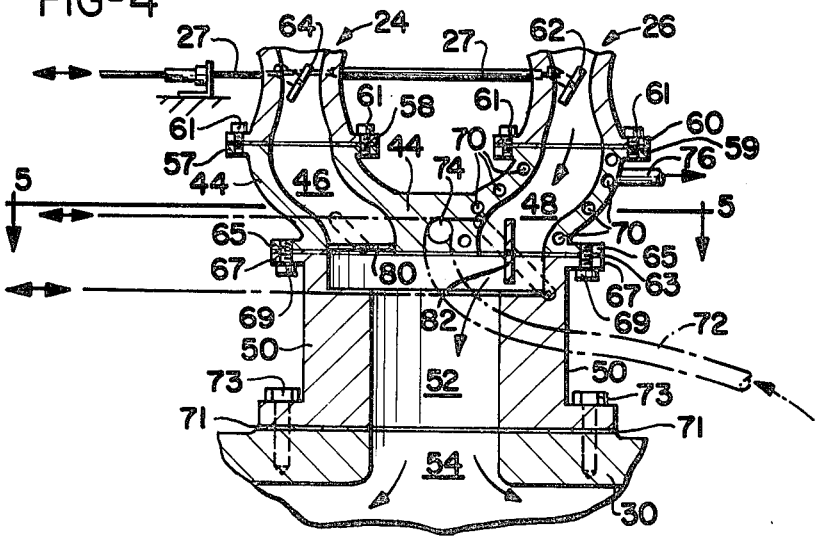
FIG. 4 is the embodiment of FIG. 3 shown in section.
Figure 5:
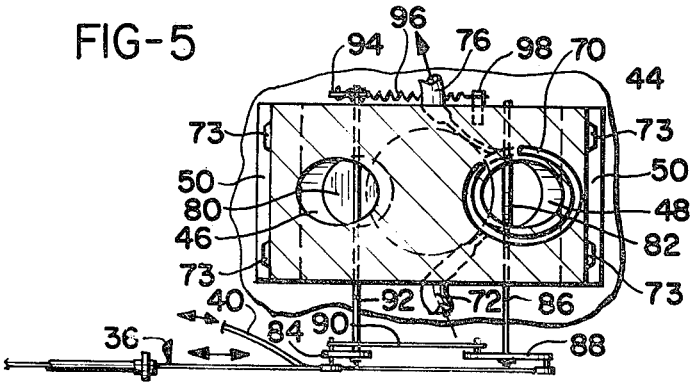
FIG. 5 is a plan view of the preferred embodiment of FIG. 4 in section taken along line 5—5.

The adapter assembly 28 is best shown in FIGS. 3, 4, and 5 and comprises a venturi means 44 which forms two venturi throats 46, 48, an adapter means 50 which forms a single passage 52 that communicates with both venturi throats 46, 48 and an opening 54 in the intake manifold 30, and the valve means 56. The venturi means 44 has flanged upper portions 57, 59 and is shaped to receive the flanged terminal portions 58, 60 of the first and second carburetors 24, 26, which can be of standard design. The first and second carburetors 24, 26 are bolted to the flanged upper portions 57, 59 of the venturi means by bolts 61, and are separated by a gasket 63. The venturi means 44 has a lower flange 65 which is bolted to an upper flange 67 of the adapter means 50 by bolts 69. A gasket 71 is placed in between the lower flange 65 and the upper flange 67 to insure a good seal. Similarly, the adapter means 50 is bolted to the intake manifold 30 by bolts 73. The throttle valves 62, 64 of the first and second carburetors 24, 26 are joined by the throttle linkage 27 and respond simultaneously to operation of the accelerator pedal 29 so that the valves are opened and closed in unison.

The venturi means 44 may include a helical duct 70 which spirals around a venturi throat 48. An inlet tube 72 attached at an end to the exhaust manifold (not shown) carries heated exhaust gases from the exhaust manifold to an inlet port 74 connected to the helical duct 70 so that the heated exhaust gases can pass adjacent to the venturi throat 48 thereby heating the fuel air mixture passing therethrough. The heated exhaust gases are then passed to the atmosphere by means of an outlet tube 76. In this fashion, a fuel-air mixture of a less volatile fuel such as alcohol can be preheated to promote its combustion.

As shown in FIG. 4, the adapter means 50 forms a single passage 52 which is enlarged at its upper end to communicate with the venturi throats 46, 48 of the venturi means. The lower portion of the single passage is shaped to communicate with an opening 78 in the intake manifold 30. The valve means 56 of the preferred embodiment comprises two butterfly plates 80, 82 located at the interface between the venturi throats 46, 48 and the upper portion of the single passage 52 of the adapter means 50.

As shown in FIG. 3, the valve linkage 36 comprises a push-pull wire 37 which is connected at an end to a knob 38 mounted remotely on a dashboard 34 and is connected at its other end to a primary link 84 which controls the position of the butterfly plate 80 by a shaft 86. The primary link 84 is joined to a secondary link 88 by a bar 90 and the secondary link controls the position of the butterfly plate 82 by a shaft 92. The butterfly plates 80, 82 are positioned so that, when one butterfly plate 82 is open, the other butterfly plate 80 is closed, and vice versa. Attached to the secondary link 88 is a slave linkage 40 which consists of a "push-pull" wire 41 which terminates at the distributor 42 so that as the primary and secondary links 84, 86 are actuated by the push-pull wire 37, the distributor timing is advanced or retarded as the butterfly plates 80, 82 open and close the venturi throats 46, 48.

As best shown in FIG. 5, the valve linkage 36 is connected to the butterfly plates 80, 82 by shafts 86, 92 which are journaled into the venturi means 44. The shaft connecting the primary link 84 with its respective butterfly plate 80 passes through the venturi means 44 and is attached to a link arm 94 on the opposite side of the venturi means. The link arm 94 is attached by a spring 96 to a post 98 which is press fitted into the venturi means 44. The tension exerted by the spring 96 on the link arm 94 is transmitted to the primary and secondary links 84, 88 and tends to keep the butterfly plate 80 in the open position.

Figure 6:
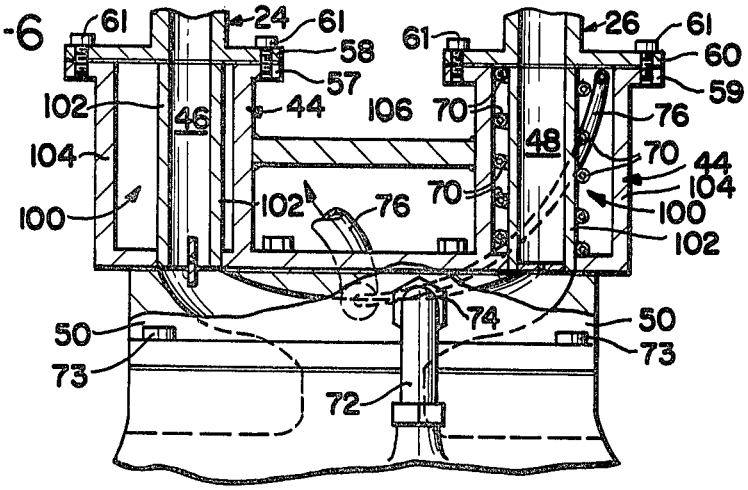
FIG. 6 is an elevation of another embodiment of the invention shown partially cut-away and in section.

As shown in FIG. 6, the venturi means 44 can be formed so that a hollow chamber 100 exists between internal walls 102 which form the walls of the venturi throats 46, 48 and external walls 104 which form the outside surface of the venturi means. In this embodiment, the helical duct 70 comprises a tube 106 of a highly heat conducting metal which coils about the internal walls 102 of the venturi throat 48.

Unlike the embodiment of FIGS. 3, 4 and 5, the embodiment of FIG. 6 does not have a flanged connection between the venturi means 44 and the adapter means 50. Instead, the venturi means 44 is bolted to the adapter means 50 by bolts 106 and the external walls 104 of the venturi throats 46, 48 are stiffened by a brace 106 which is welded between the throats.

Figure 7:
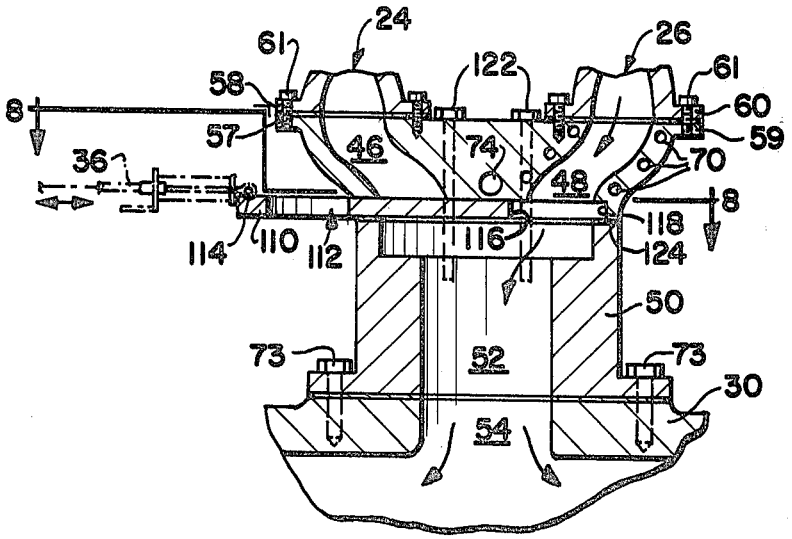
FIG. 7 is an elevation in section of embodiment in which the valve means comprises a slide plate.
Figure 8:
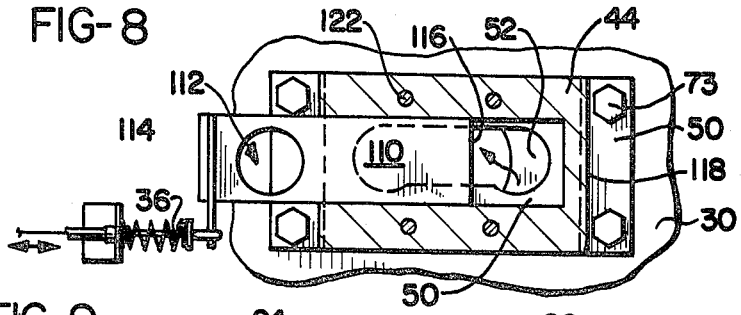
FIG. 8 is a plan view of the embodiment of FIG. 7 in section taken along line 8—8.

A different embodiment of the adapter assembly is shown in FIGS. 7 and 8. A rectangular groove 108 is formed in the bottom portion of the venturi means 44 and the valve means 56 consists of a slide plate 110 which fits within the rectangular groove and has a hole 112 at an end. The slide plate 110 is connected at an external end 114 to the venturi means 44 to the push-pull wire 37 of the valve linkage 36 so that movement of the push-pull wire 37 moves the slide plate within the rectangular groove 108. The hole 112 is positioned on the slide plate 110 such that when the slide plate is moved so that its internal end 116 abuts the end 118 of the rectangular groove 108, the hole is in registry with the upper flared portion of the single passage 52 and the venturi throat 46 of the first carburetor 24. When the slide plate 110 is positioned so that the hole 112 is not in registry with the venturi throat 46 or the single passage 52, the internal end 116 of the slide plate forms an interior wall of an opening 120 that joins the venturi throat 48 of the second carburetor 26 with the single passage 52.

The venturi throat 44 is secured to the adapter means 50 by long bolts 122. The venturi throat 44 is separated from the adapter means 50 by a gasket 124.

Figure 9:
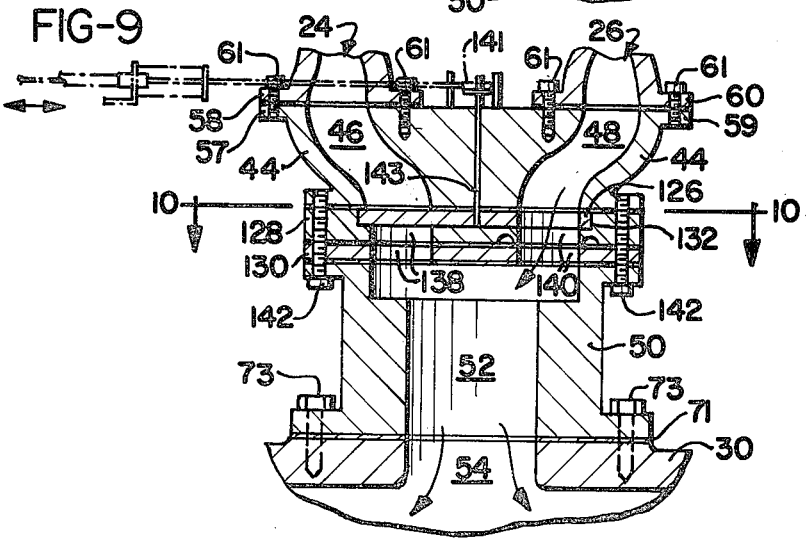
FIG. 9 is an elevation in section of an embodiment of the invention in which the valve means comprises a rotating disc.
Figure 10:
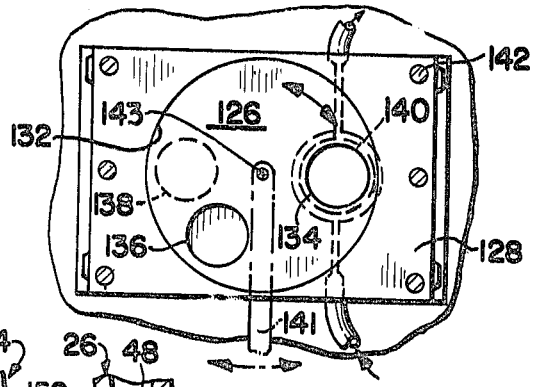
FIG. 10 is a plan view of the embodiment of FIG. 9 taken at line 10—10.

An additional embodiment of the invention is shown in FIGS. 9 and 10. The venturi means 44 and the adapter means 50 are the same configuration as that of the preferred embodiment (shown in FIGS. 3, 4, and 5), but the valve means consists of a rotating disc 126, positioned directly below the venturi means, and first and second spacer plates 128, 130 positioned beneath the rotating disc and above the adapter means. The first spacer plate 128 has a circular recess 132 sized to receive the rotating disc 126. The rotating disc 126 forms two holes 134, 136 whose centers are not on a line with the center of the disc. The first and second spacer plates 128, 130 each have two holes 138, 140 whose centers are on a line with the center of the rotating disc 126 and are in registry with the upper portion of the single passage 52 within the adapter means 50 and the venturi throats 46, 48. The rotating disc 126 is connected to the "push-pull" wire 37 by a control arm 141 which extends from a control rod 143 press fitted into the center of the rotating disc 126. Thus, a passageway from a desired venturi throat can be formed by rotation of the rotating disc 126 to align one of the holes 134, 136 of the rotating disc 126 with a venturi throat 46, 48 and the holes 138, 140 of the first and second spacer plates 128, 130.

The venturi means 44, first and second spacer plates 128, 130, and adapter means are held together by bolts 142.

Figure 11:
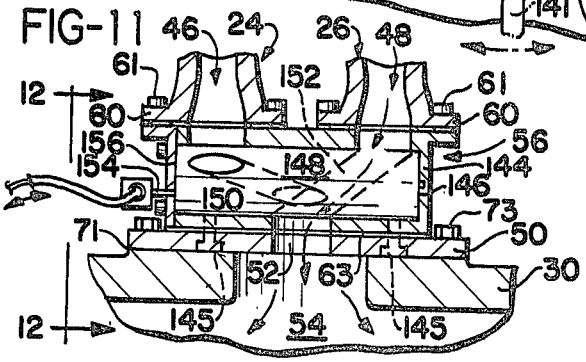
FIG. 11 is an elevation in section of the invention in which the valve means comprises a drum mounted within a chamber.
Figure 12:
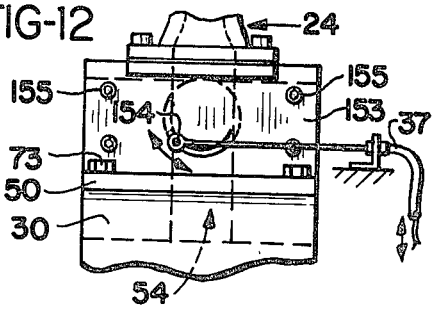
FIG. 12 is a left side elevation of the embodiment of FIG. 11.

In the embodiment shown in FIGS. 11 and 12, the valve means 56 comprises a valve box 144 having a cylindrical chamber 146 and open at one side, and a drum 148 journaled within the chamber having two skewed channels 150, 152 passing therethrough and positioned so that one or the other of the two venturi throats 46, 48 is joined by a channel to the single passage 52 of the adapter means 50. A cover plate 153, secured to the side of the valve box 144 by bolts 155, secures the drum 148 within the chamber 146 and has a slot 157. The valve box 144 is attached to the adapter means 50 by bolts 145 countersunk in the adapter means. The "push-pull" wire 37 of the valve linkage 36 is attached to the drum 148 by a peg 154 which is press fitted into an end 156 of the drum at a point near its outer periphery and extends through a slot 157 in the cover plate 153. Movement of the "push-pull" wire 37 causes the drum 148 to rotate thereby positioning one of the two channels 150, 152 in registry with its respective venturi throat 46, 48 and the single passage 52 in the adapter means 50.

Figure 13:
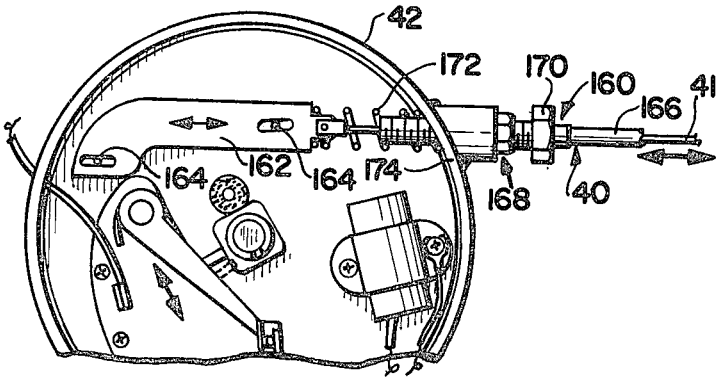
FIG. 13 is a plan view in schematic form of the distributor for an internal combustion engine showing the terminal portion of the slave linkage.

As shown in FIG. 13 the slave linkage 40 comprises a "push-pull" wire 41 which is attached at an end 158 to the primary link of the valve linkage 36 (see FIG. 3), is attached at its other end 160 to a bracket arm 162 which slidably engages pins 164 within the distributor 42 of the automobile 10. The outer jacket 166 of the "push-pull" wire 41 is connected to the distributor 42 at an opening 168 threaded to receive a lock bolt 170 mounted on the slave linkage 40. Inside the distributor 42 the bracket arm 162 is held in place by means of a spring 172 which urges against an interior surface 174 of the distributor 42.

The adapter means 50 and valve means 56 can be fabricated from heat resistant cast iron. All mating surfaces formed when two elements of the aforementioned embodiment are bolted together should be separated by a suitable gasket in a manner shown in FIG. 3 to prevent leakage.

The operation of the dual fuel system is the same regardless of which embodiment of the invention is retrofitted to the automobile 10. If the automobile is operating in the gasoline mode—that is, gasoline from the standard fuel tank 12 is being pumped through the fuel line 20 by the standard fuel pump 14 into the first carburetor 24, mixed with air, passed through the respective venturi throat 46, valve means 56, and single passage 52 into the manifold 30—conversion to the second fuel system which utilizes fuel stored in the second fuel tank 16 is as follows.

The driver first throws the fuel pump relay switch 32 which starts the second fuel pump 18 located on the fuel line 22 from the second fuel tank 16 and an alternate fuel is thereby pumped into the second carburetor 26. The driver then throws a switch on the dashboard 34 controlling the valve linkage 36 which positions the valve means 56 to close the passageway between the first carburetor 24 and the manifold 30 and open the passageway between the second carburetor 26 and the manifold. The resulting loss of vacuum in the carburetor 24 will shut off the standard fuel pump 14 automatically, since the standard fuel pump is pressure sensitive.

If for example, alcohol is used as the fuel in the second fuel tank 16 it would be desirable to preheat the alcohol air mixture leaving the second carburetor 26 so that it would become more volatile and burn more efficiently. The alcohol air mixture leaving the second carburetor travels down the respective venturi throat 48 and is heated by hot exhaust gases passing through the helical duct 70 which encircles the venturi throat of the venturi means 44.

It is also desirable when buring an alcohol air mixture to advance the timing of the distributor approximately 8° over that used in a gasoline mode. The slave linkage 40, which is driven by the valve linkage 36, automatically advances the distributor 42 the desired amount.

The same steps can be taken to return the automobile to a gasoline mode. The fuel pump relay switch is thrown 32, thereby shutting off the second fuel pump 18. The standard fuel pump 14 pumps gasoline to the first carburetor 24, and the valve linkage 36 connected to the valve means 56 is adjusted to open the passageway between the first carburetor 24 and the manifold 30 and closing the passageway between the second carburetor 26 and the manifold 30. Tests utilizing the preferred embodiment of the invention have shown that such a changeover can be accomplished while the automobile is moving and results in only a slight interruption of power.

While the forms of apparatus herein described constitute embodiments of this invention, it is to be understood that the invention is not limited to these precise forms of apparatus, and that changes may be made therein without departing from the scope of the invention.

What is claimed is:

1. A dual fuel system for an automobile engine having an intake manifold forming an intake opening, and an exhaust manifold, comprising:

at least two fuel tanks;

at least two carburetors, each communicating with a fuel tank and having a common throttle linkage and an outlet port; and an adapter assembly forming a pathway between each outlet port of a carburetor and the intake opening, the adapter assembly having a venturi means forming at least two venturi throats, each throat in registry with an outlet port of a carburetor;

an adapter means forming a single passage therethrough and including an end adapted to be mounted on the intake manifold such that the passage is in registry with the intake opening; and a valve means, located between the venturi means and the adapter means, for alternately opening and closing a pathway from a preselected outlet port to the intake opening so that only one outlet port communicates with the single passage at a time.

2. The dual fuel system of claim 1 wherein the venturi means forms a helical duct which spirals about a selected venturi throat and communicates with the exhaust manifold so that heated exhaust gas passes about the selected venturi throat and preheats an air-fuel mixture passing therethrough.

3. The dual fuel system of claim 1 wherein the valve means includes a slave linkage which is connected to a distributor on the automobile engine so that the timing of the distributor may be changed when a predetermined pathway is opened by the valve means.

4. The dual fuel system of claim 1 wherein the valve means comprises two butterfly valves, each positioned within a venturi throat of the venturi means; and a valve linkage which remotely controls the position of the butterfly valves such that as a first butterfly valve is in the closed position thereby closing the pathway from the respective venturi throat to the intake manifold, the other butterfly valve is in an open position thereby opening a pathway from a venturi throat to the intake manifold.

5. The dual fuel system of claim 1 wherein the venturi means forms a groove in a surface abutting the adapter means and the valve means comprises a slide plate recessed within the groove and forming a perforation; the valve means further comprising a valve linkage connected to an external end of the slide plate such that the slide plate can be remotely positioned to alternately open and close a pathway from a predetermined venturi throat to the intake manifold.

6. The dual fuel system of claim 1 wherein the valve means comprises:

a rotating disc which abuts a lower portion of the venturi means and forms two holes whose centers are not on a line with the center of the rotating disc;

a spacer plate having a recess sized to receive the rotating disc and having two holes formed therein whose centers are on a line with the center of the recess and communicate with the single passage of the adapter means; and a valve linkage connected to the rotating disc such that a hole of the rotating disc may be positioned to form a single pathway from a preselected venturi throat through a hole in the spacer plate to the intake manifold.

7. The dual fuel system of claim 1 wherein the valve means comprises:

a valve box forming a cylindrical chamber therein which communicates with each venturi throat and the single passage of the adapter means;

a drum having skewed channels formed therein and rotatably mounted within the cylindrical chamber so that the drum may be rotated alternately to open a pathway from a preselected venturi throat to the intake manifold and close a pathway from another venturi throat to the intake manifold; and a valve linkage connected to an end of the drum such that the drum may be rotated within the cylindrical chamber from a remote position.

8. A dual fuel system for an automobile engine having an intake manifold forming an intake opening, and an exhaust manifold comprising:

at least two fuel tanks;

at least two carburetors, each communicating with a fuel tank and having a common throttle linkage and an outlet port; and an adapter assembly forming a pathway between each outlet port of a carburetor and the intake opening, the adapter assembly having a venturi means forming at least two venturi throats, each throat in registry with an outlet port of a carburetor, and forming a helical duct which spirals about a selected venturi throat and communicates with the exhaust manifold so that heated exhaust gas passes about the selected venturi throat and preheats an air-fuel mixture passing therethrough; and a valve means including two butterfly valves, each positioned within a venturi throat of the venturi housing, a valve linkage which remotely controls the position of the butterfly valves such that as a first butterfly valve is in a closed position thereby closing the pathway from the respective venturi throat to the intake manifold, the other butterfly valve is in an open position thereby opening a pathway from a venturi throat to the intake manifold; and a slave linkage which is connected to a distributor on the automobile engine so that the timing of the distributor may be changed when a predetermined pathway is opened by the valve.

9. In an automobile engine having an intake manifold forming an intake opening; an exhaust manifold; and two carburetors, each supplied by a separate fuel source; an adapter assembly forming a pathway between an outlet port of each carburetor and the intake opening; the adapter assembly comprising:

a venturi means forming at least two venturi throats, each throat in registry with an outlet port of a carburetor;

an adapter means forming a single passage therethrough and including an end adapted to be mounted on the intake manifold such that the passage is in registry with the intake opening; and a valve means, located between the venturi housing and the adapter means for alternately opening and closing a pathway from a preselected outlet port to the intake opening so that only one outlet port communicates with the single passage at a time.

10. The adapter assembly of claim 9 wherein the venturi means forms a helical duct which spirals about a selected venturi throat and communicates with the exhaust manifold so that heated exhaust gas passes about the selected venturi throat and preheats an air-fuel mixture passing therethrough.

11. The adapter assembly of claim 9 wherein the valve means includes a slave linkage which is connected to a distributor on the automobile engine so that the timing of the distributor may be changed when a predetermined pathway is opened by the valve means.

12. The adapter assembly of claim 9 wherein the valve means comprises two butterfly valves, each positioned within a venturi throat of the venturi means; and a valve linkage which remotely controls the position of the butterfly valves such that as a first butterfly valve is in the closed position thereby closing the pathway from the respective venturi throat to the intake manifold the other butterfly valve is in an open position thereby opening a pathway from a venturi throat to the intake manifold.

13. The adapter assembly of claim 9 wherein the venturi means forms a groove in a surface abutting the adapter means and the valve means comprises a slide plate recessed within the groove and forming a perforation; the valve further comprising a valve linkage connected to an external end of the slide plate such that the slide plate can be remotely positioned to alternately open and close a pathway from a predetermined venturi throat to the intake manifold.

14. The adapter assembly of claim 9 wherein the valve means comprises:

a rotating disc which abuts a lower portion of the venturi means and forms two holes whose centers are not on a line with the center of the rotating disc;

a spacer plate having a recess sized to receive the rotating disc and forming two holes therein whose centers are on a line with the center of the recess and communicate with the single passage of the adapter means; and a valve linkage connected to the rotating disc such that a hole of the rotating disc may be positioned to form a single pathway from a preselected venturi throat through a hole in the spacer plate to the intake manifold.

15. The adapter assembly of claim 9 wherein the valve means comprises:

a valve box forming a cylindrical chamber therein which communicates with each venturi throat and the single passage of the adapter means;

a drum having skewed channels formed therein and rotatably mounted within the cylindrical chamber so that the drum may be rotated alternately to open a pathway from a preselected venturi throat to the intake manifold and close a pathway from another venturi throat to the intake manifold; and a valve linkage connected to an end of the drum such that the drum may be rotated within the cylindrical chamber from a remote position.

16. In an automobile engine having an intake manifold forming an intake opening; an exhaust manifold; and two carburetors, each supplied by a separate fuel source; an adapter assembly forming a pathway between each outlet port of a carburetor and the intake opening, the adapter assembly comprising:

a venturi means forming at least two venturi throats, each throat in registry with an outlet port of a carburetor, and forming a helical duct which spirals about a selected venturi throat and communicates with the exhaust manifold so that heated exhaust gas passes about the selected venturi throat and preheats an air-fuel mixture passing therethrough;

an adapter means forming a single passage therethrough and including an end adapted to be mounted on the intake manifold such that the passage is in registry with the intake opening; and a valve means including two butterfly valves, each positioned within a venturi throat of the venturi means, a valve linkage which remotely controls the position of the butterfly valves such that as a first butterfly valve is in the closed position thereby closing the pathway from the respective venturi throat to the intake manifold the other butterfly valve is in an open position thereby opening a pathway from a venturi throat to the intake manifold, and a slave linkage which is connected to a distributor on the automobile engine so that the timing of the distributor may be changed when a predetermined pathway is opened by the valve.

* * * * *